US005190114A

United States Patent [19]

Walter

[11] Patent Number: 5,190,114

[45] Date of Patent: Mar. 2, 1993

[54] FLOW PULSING APPARATUS FOR DRILL STRING

[75] Inventor: Bruno H. Walter, Edmonton, Canada

[73] Assignee: Intech International Inc., Edmonton, Canada

[21] Appl. No.: 781,760

[22] Filed: Oct. 23, 1991

Related U.S. Application Data

[63] Continuation of Ser. No. 645,146, Jan. 24, 1991, abandoned, which is a continuation-in-part of Ser. No. 436,603, Nov. 15, 1989, Pat. No. 5,009,272.

[30] Foreign Application Priority Data

Nov. 25, 1988 [CA] Canada ..... 584145
Jun. 22, 1989 [CA] Canada ..... 603594

[51] Int. Cl.[5] ..... E21B 7/18; E21B 7/24; E21B 4/14; E21B 31/113

[52] U.S. Cl. ..... 175/56; 175/67; 175/232; 175/297; 166/177; 166/249; 166/286; 166/312

[58] Field of Search ..... 175/56, 296, 297, 25, 175/38, 65, 67, 241, 242, 232, 298, 317; 166/177, 178, 286, 301, 308, 249; 367/83, 85; 137/14, 829, 830; 446/205, 207; 116/137 R

[56] References Cited

U.S. PATENT DOCUMENTS

| | | | |
|---|---|---|---|
| 701,391 | 6/1902 | Pruszkowski | 175/92 |
| 1,748,460 | 2/1930 | Petrie | 446/205 |
| 2,053,982 | 9/1936 | Weiss | 446/205 |
| 2,113,396 | 4/1938 | Butterfield | 446/205 |
| 2,287,157 | 6/1942 | Wolff | 175/106 |
| 2,620,162 | 12/1952 | Pennington | 175/232 X |
| 2,713,472 | 7/1955 | Bodine, Jr. | 175/56 |
| 2,743,083 | 4/1956 | Zublin | 175/56 |
| 2,746,721 | 5/1956 | Moore | 175/317 |
| 2,750,154 | 6/1956 | Boice | 175/106 X |
| 2,780,438 | 2/1957 | Bielstein | 175/92 |
| 2,902,258 | 9/1959 | Hildebrandt | 175/56 |
| 3,001,322 | 9/1961 | Sanders | 446/207 |
| 3,029,554 | 4/1962 | Mobley | 446/207 X |
| 3,065,805 | 11/1962 | Martini | 175/56 |
| 3,096,833 | 7/1963 | Bodine | 175/56 |
| 3,105,560 | 10/1963 | Zublin | 175/56 |
| 3,194,325 | 7/1965 | Gianelloni, Jr. | 175/107 |
| 3,295,837 | 1/1967 | Bodine, Jr. | 175/56 |
| 3,307,641 | 3/1967 | Wiggins, Jr. | 175/56 |
| 3,346,058 | 10/1967 | Bouyoucos | 175/56 |
| 3,415,330 | 12/1968 | Bouyoucos | 175/56 |
| 3,416,613 | 12/1968 | Henderson | 173/57 |
| 3,431,984 | 3/1969 | Buehler, Jr. | 175/297 |
| 3,441,094 | 4/1969 | Galle et al. | 175/56 |
| 3,568,783 | 3/1971 | Chenoweth | 175/92 |
| 3,603,410 | 9/1971 | Augona | 175/65 |
| 3,768,576 | 10/1973 | Martini | 173/73 |
| 3,807,512 | 4/1974 | Pogonowski et al. | 175/106 |
| 3,958,217 | 5/1976 | Spinnier | 367/83 |
| 4,434,863 | 3/1984 | Garrett | 175/321 |
| 4,520,886 | 6/1985 | Marais | 173/135 |
| 4,807,709 | 2/1989 | Falgout, Sr. et al. | 166/178 X |
| 4,817,739 | 4/1989 | Jeter | 175/317 X |
| 4,819,745 | 4/1989 | Walter | 175/107 |
| 4,830,122 | 5/1989 | Walter | 175/106 |
| 4,950,201 | 8/1990 | Sceery | 446/207 |
| 4,979,577 | 12/1990 | Walter | 175/56 |

FOREIGN PATENT DOCUMENTS

| | | |
|---|---|---|
| 0370709 | 5/1990 | European Pat. Off. . |
| 2656045 | 6/1991 | France . |

*Primary Examiner*—Stephen J. Novosad
*Attorney, Agent, or Firm*—John W. Ross; Robert M. Phipps

[57] ABSTRACT

This invention relates to flow pulsing methods and apparatus for various applications including downhole drilling equipment and in particular to an improved flow pulsing method and apparatus of this type to be connected in a drill string above a drill bit with a view to securing improvements in the drilling process.

21 Claims, 8 Drawing Sheets

FLOW PULSING APPARATUS FOR DRILL STRING

This is a continuation of my co-pending application Ser. No. 07/645,146 filed Jan. 24, 1991, now abandoned, which is a continuation-in-part of my application Ser. No. 07/436,603 filed Nov. 15, 1989 (now U.S. Pat. No. 5,009,272 issued Apr. 23, 1991), the disclosure of which is incorporated herein by reference.

This invention relates to flow pulsing apparatus for use in various applications, such as in down-hole drilling equipment and in particular to an improved flow pulsing apparatus of this type adapted to be connected in a drill string above a drill bit with a view to securing improvements in the drilling process.

U.S. Pat. No. 4,819,745 issued Apr. 11, 1989 naming Bruno H. Walter as inventor, contains a detailed description of the classical rotary drilling method and the manner in which drilling fluid or drilling mud is pumped downwardly through the hollow drill string with the drilling mud cleaning the rolling cones of the drill bit and removing or clearing away rock chips from the cutting surface and then lifting and carrying such rock chips upwardly along the well bore to the surface. That patent discusses the effect of jets on the drill bit to provide high velocity fluid flows near the bit. In general, these jets serve to increase the effectiveness of the drilling, i.e. they increase the penetration rate.

The above U.S. patent also describes the use in the drill string of vibrating devices thereby to cause the drill string to vibrate longitudinally, which vibrations are transmitted through the drill bit to the rock face thus increasing the drilling rate. Certain of the earlier devices include mud hammers while others include turbine driven rotary valve devices for periodically interrupting the flow of mud in the drilling string just above the drill bit thereby to provide a cyclical or periodic water-hammer effect which axially vibrates the drill string and vibrates the drill bit thus increasing the drilling rate somewhat. These prior art devices were subject to a number of problems as noted in the above U.S. Pat. No. 4,819,745.

More recent forms of apparatus for increasing the drilling rate by periodically interrupting the flow to produce pressure pulses therein and a water-hammer effect which acts on the drill string to increase the penetration rate of the bit are described in my U.S. Pat. No. 4,830,122 issued May 16, 1989 and in my U.S. Pat. No. 4,979,577 issued Dec. 25, 1990. These devices (incorporating axially movable valve members) have provided a significant improvement over the known prior art rotary valve arrangements and have been less prone to jamming and seizing as the result of foreign matter in the drilling fluid. At the same time there is a need to improve still further the operating characteristics of the device and to enable the production of high quality pulsations while at the same time providing for a reduced incidence of jamming or sticking of the apparatus as a result of the action of foreign matter travelling downwardly with the drilling fluid.

SUMMARY OF THE INVENTION

It is a general object of the present invention to provide improved flow pulsing apparatus for various applications wherein vibrating and/or flow pulsing effects are desired, for example, vibrating a drill string and a drill bit to increase the drilling rate and to pulse the flow of drilling fluid emitting from the drill bit jets thereby to enhance the cleaning effect and the drilling rate.

Accordingly, there is provided a flow pulsing apparatus including a housing providing a passage for a flow of fluid and means for periodically restricting the flow through said passage to create pulsations in the flow and a cyclical water-hammer effect to vibrate the housing during use. In particular, the above-noted passage includes a constriction means through which the flow is accelerated so as to substantially increase the flow velocity and a passage region through which the accelerated fluid can flow, followed by a downstream region of fluid deceleration. In order to effect the periodic restriction of the flow a control means is associated with the passage region and is movable between an open, full flow position, and a closed flow restricting position. This control means is responsive to alternating differential fluid pressures acting on opposing sides thereof so as to move or vibrate the control means rapidly between the above-noted positions to pulsate the flow. The alternating differential pressures apparently are created as a result of the fact that in the open position of the control means the fluid through-flow at relatively high velocity effects a pressure reduction on one side of the control means while the pressure on the other side is higher (as it is exposed to the higher pressures associated with the downstream lower velocity region) thus tending to effect closure of the control means. However, once closure or flow restriction occurs, the pressure and force differential on the control means is reversed because of the water-hammer effect created upstream of the control means coupled with a pressure drop on the downstream side. This action serves to rapidly open the control means whereupon the differential pressure acting on the control means is again reversed so that the sequence described above repeats itself. This action occurs in a rapid cyclical manner.

In the embodiments to be described hereafter the control means takes several different forms. In one group of embodiments (also described in application Ser. No. 07/436,603) it is in the form of one or more pivoting flap valves.

An improved version of the control means to be described hereafter is in the form of a rolling element, preferably a cylindrical element, which takes the place of the pivoting flap valve. By using a rolling element, frictional effects are reduced and the control element is less prone to wear and breakage as compared with the pivoting flap. Other advantages will become apparent to those skilled in this art.

Regardless of the form of the control means, all of them are in use acted on by the alternating differential pressures arising during use to achieve the flow pulsing effect desired.

In the preferred form of the invention the flow pulsing apparatus is adapted to be connected in a drill string above a drill bit to "pulse" the flow of drilling fluid passing toward the bit thereby to vibrate the drill bit and enhance the hole bottom cleaning effect, thus increasing the drilling rate.

The invention will be better understood from the following description of preferred embodiments of same, reference being had to the accompanying drawings.

BRIEF DESCRIPTION OF THE VIEWS OF DRAWINGS

DETAILED DESCRIPTION OF THE PREFERRED EMBODIMENTS

Figure 1:
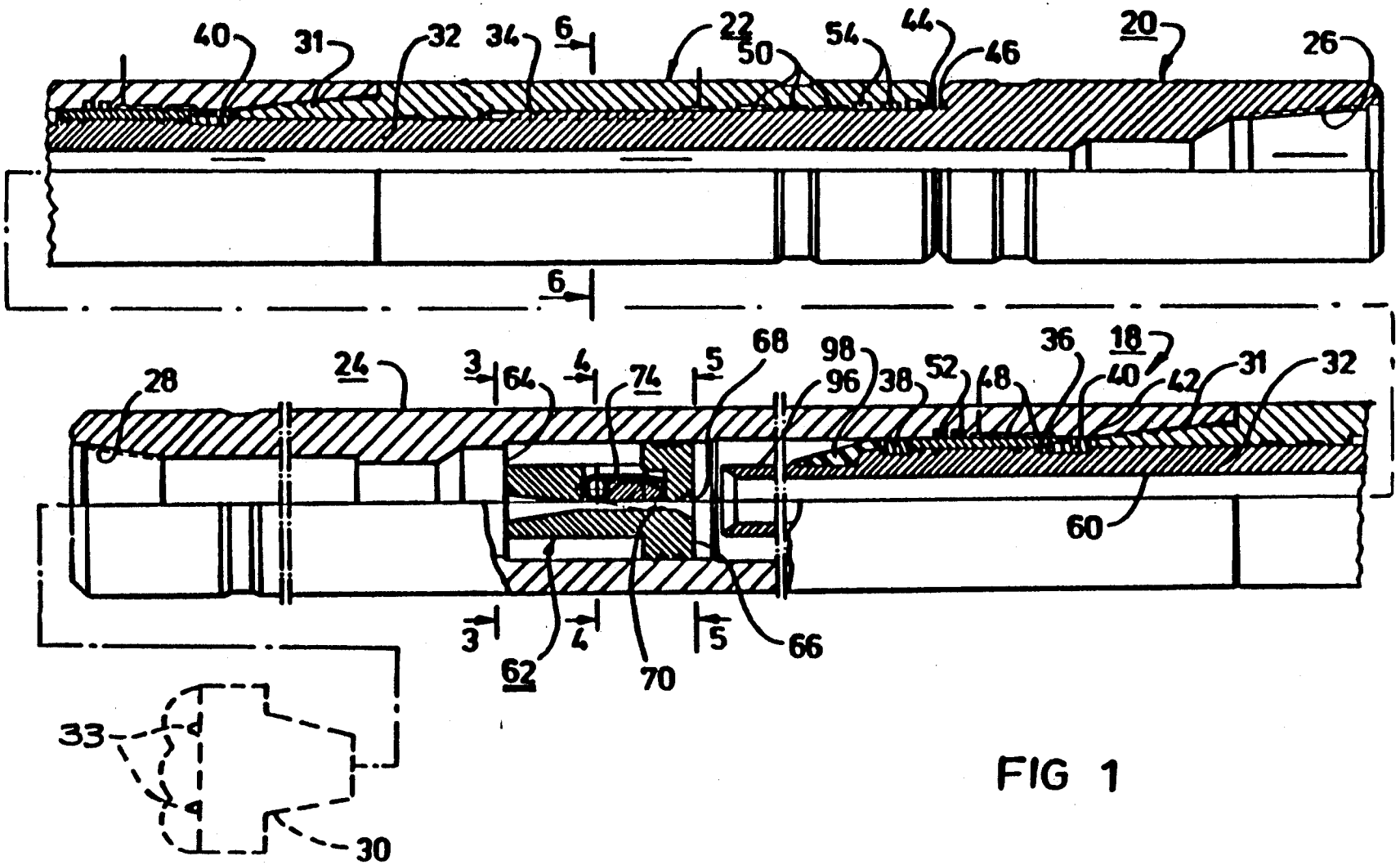
FIG. 1 is a longitudinal section through an apparatus for producing high frequency pulses in the drilling fluid in accordance with one embodiment of the invention.
Figure 2:
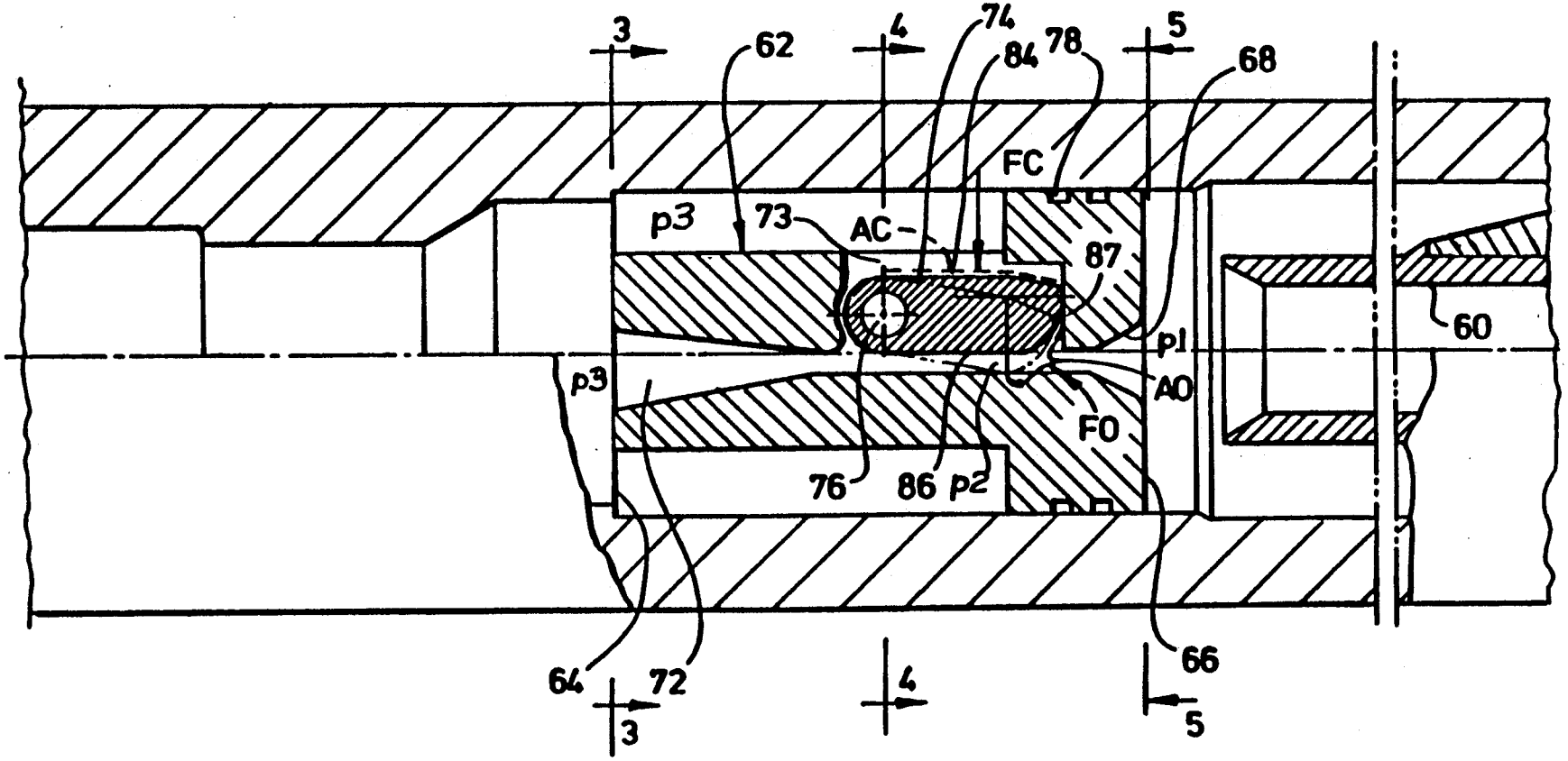
FIG. 2 is an enlarged portion of FIG. 1 showing the flow pulsing means in further detail.

Referring to FIGS. 1-6 a preferred embodiment of the invention as described and claimed in my application Ser. No. 07/436,603, now U.S. Pat. No. 5,009,272 is shown in detail. The apparatus 18 includes an external tubular housing including upper housing 20, intermediate housing 22, and lower housing 24. Upper housing 20 has an internally threaded portion 26 for connection to the lower end of a drill string (not shown), while lower housing 24 has an internally threaded portion 28 for connection to a conventional drill bit 30 (shown in phantom) having conventional bit jets 33 for bottom hole cleaning as noted previously Intermediate housing 22 is connected to lower housing 24 via tapered threaded portions 31.

The upper housing 20 has an elongated neck 32 which extends within the intermediate housing 22 and well down into the lower housing 24. Interengaging splines 34 between the housings 20 and 22 serve to transmit torque while allowing a measure of relative axial movement between them.

The lower end of the neck 32 is surrounded by a sleeve 36 having a smooth hard surface. Split rings 38 and 40 butt against opposing ends of sleeve 36 and the uppermost split ring 40 can make contact with shoulder 42 on the lower end of intermediate housing 22 to retain the upper housing 20 in place. A limited amount of axial play between the upper housing 20 and the lower and intermediate portions 24,22 is permitted with shoulders 44, 46 on the intermediate and upper housings 22, 20 making contact when the weight of the drill string is applied (as during drilling) while split ring 40 butts up against shoulder 42 when the tool is under tension (as during lifting out of the hole). Wear rings 48, 50 and seal rings 52, 54 are provided between the relatively movable assemblies described above and a suitable lubricant is provided on the relatively movable surfaces.

The neck 32 of the upper housing portion 20 has an elongated central bore 60 therein of constant diameter defining a passage for drilling fluid from the upper end of the tool downwardly toward the flow control means which will now be described.

Seated in the central passage defined by the bottom housing 24 just downstream of the neck 32 and against a step 64 provided in the housing interior wall is a Venturi assembly having a control element or valve therein that provides intermittent restriction of the flow of drilling mud or fluid. The drilling mud or fluid is pumped downwardly in well known fashion through the drill string from the surface and passes along the bore 60 in neck 32 in the direction of the arrows. The manner in which this flow is intermittently restricted or pulsed will be apparent from the following description.

The several views (FIGS. 3-5) taken through the assembly show the Venturi assembly as including a Venturi body 62 having an upstream face 66 within which is defined an area of gradual flow constriction 68 (a downwardly tapering area), a passage region of high velocity (having a rectangular slot-like cross-section) designated as 70 and a downstream region of gradual expansion defined by diffuser 72 (also of rectangular slot-like configuration).

In the upper portion of the Venturi body 62 there is provided a pocket 73 within which a flap 74 is freely pivoted at its downstream end by means of a transverse pivot shaft 76. The open full-flow position of the flap 74 is shown in full lines (i.e. the flap 74 is within its pocket clear of the passage region 70) while the dotted lines show the position of the flap when such flap is in the closed, flow restricting position (i.e. the upstream portion of flap 74 is within the passage region 70). The flap 74 shown in FIGS. 1 and 2 has flattened inside and outside faces 86, 84 and a convexly curved upstream end surface 87. Flap 74 has a rectangular outline shape when seen end-on (looking in the axial direction) and also when seen looking toward the inside or outside faces 84, 86.

The fluid pressure acting above the Venturi body 62 is sealed by high pressure annular seals 78 interposed between the body 62 and the housing interior wall. The various components including the Venturi body 62 and the flap 74 are made of a hard surfaced metal to reduce wear arising from contact with the drilling fluid.

Figure 3:
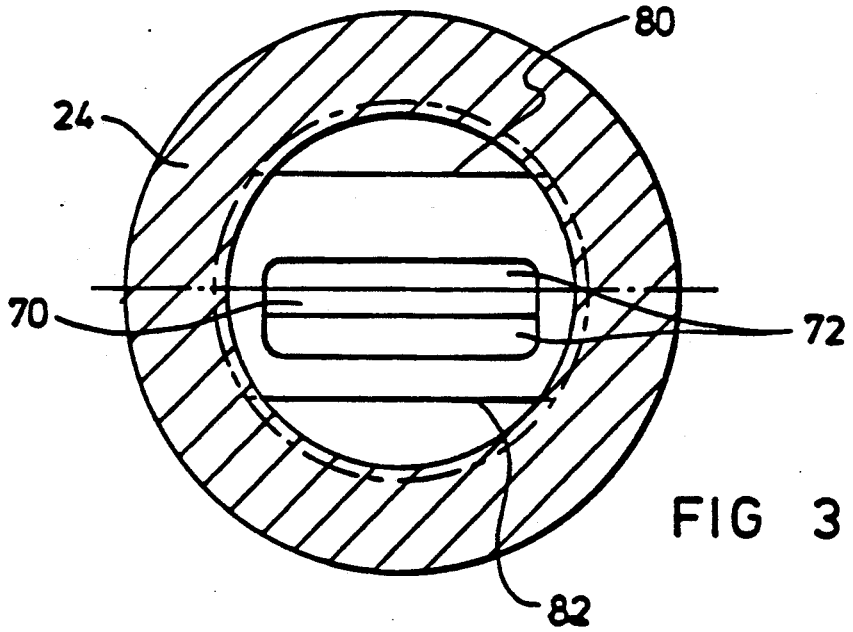
FIG. 3 is a cross-section view taken along line 3—3 of FIG. 1 or 2.
Figure 4:
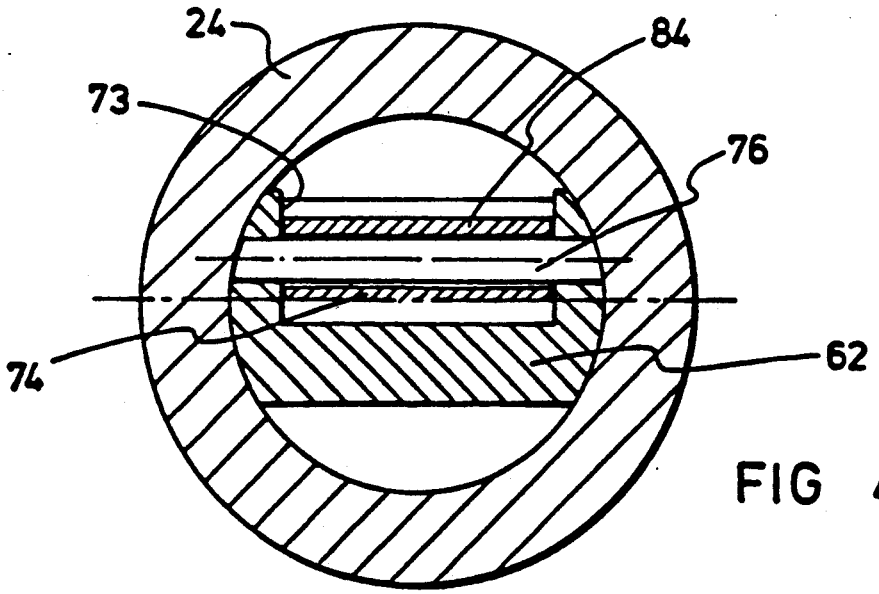
FIG. 4 is a cross-section view taken along line 4—4 of FIG. 1 or 2.
Figure 5:
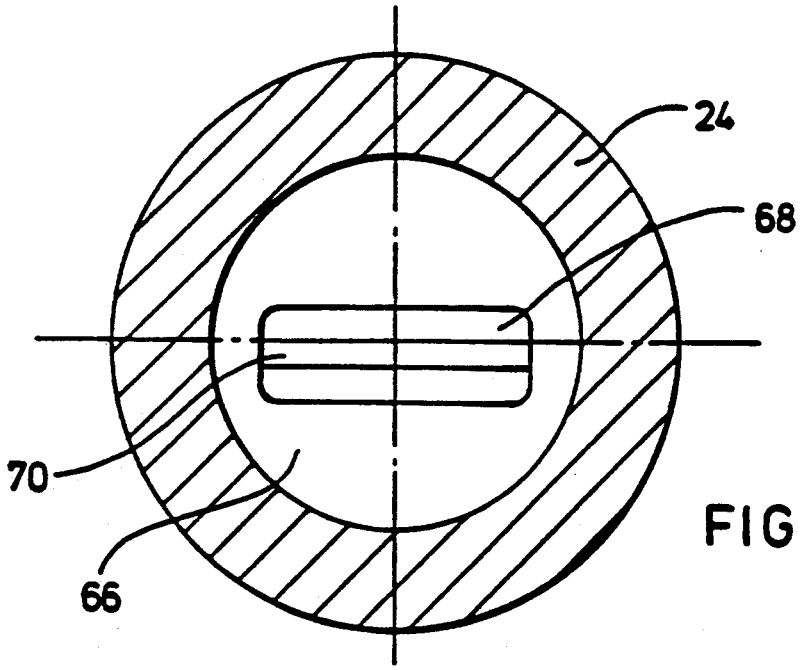
FIG. 5 is a cross-section view taken along line 5—5 of FIG. 1 or 2.
Figure 6:
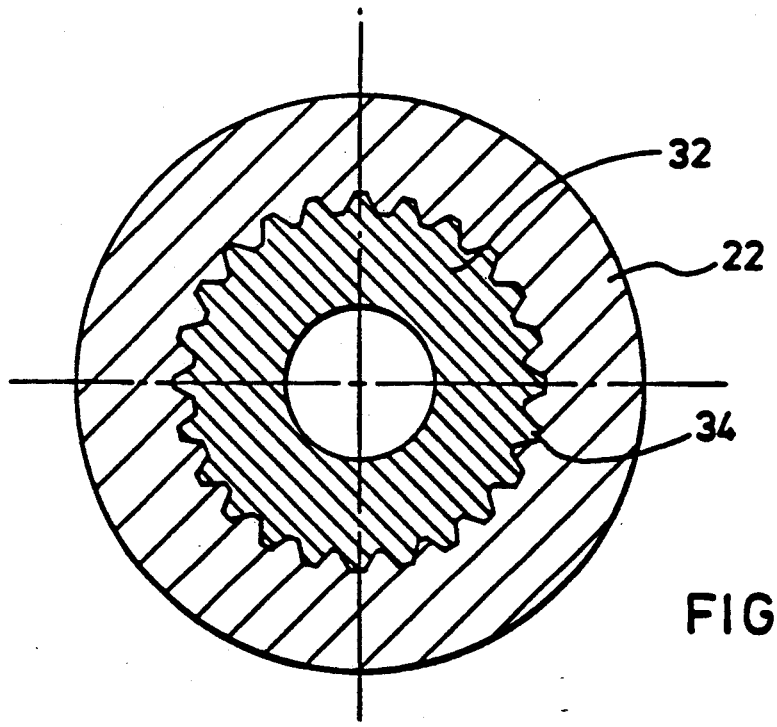
FIG. 6 is a cross-section view taken along line 6—6 of FIG. 1.

FIG. 4 shows a cross-section taken along line 4—4 of FIG. 1. In this view, the flap 74 is shown in its relationship to the Venturi body 62. The downstream end of the Venturi body 62 is further illustrated in the cross-sectional view of FIG. 3. FIG. 5 shows a cross-section of the tool upstream of the Venturi body 62. The shape of the tapering flow constriction 68 and the high velocity passage region 70 are clearly shown.

The Venturi body 62, as best seen in FIGS. 3 and 4, is shaped in such a way (with flattened side portions 80 and 82) and with the pocket 73 in which flap 74 is located being "open" on side 80 (FIG. 4) that the outside face 84 of the flap is effectively exposed to the fluid pressure existing downstream of the diffuser section 72. At the same time the opposing inside face 86 is at least partially exposed to the fluid within the high velocity passage 70. (The effects of differing flap arrangements including the effective sizes of the areas of the flap faces on which the fluid pressures act will be described in further detail later).

In the operation of the embodiment shown in FIGS. 1-5, the drilling fluid or mud is being pumped downwardly through the central bore of the drill string in the direction of the arrows and has pressure and velocity (p1) and (v1) as it moves along the bore 60 and approaches the Venturi body 62. As the drilling fluid moves downwardly toward the Venturi body 62, the drilling fluid is accelerated in the flow constriction 68 and it enters the slot-like high velocity passage 70. In this high velocity region 70, the fluid pressure (p2) is reduced in accordance with Bernoulli's principle, i.e.$(p1-p2)=\frac{1}{2}K(v_2^2-v_1^2)$ and this reduced pressure acts on the inside surface 86 of the pivotally mounted flap 74. It is noted here that references to Bernoulli effect are for convenience in describing the First Law (conservation of energy) phenomena occurring. Other "First Law" effects such as friction losses and heating or cooling effects have been neglected. It will be appreciated by those skilled in the art that the formulation of a theory of operation for this equipment poses substantial difficulties in that it is extremely difficult to provide instruments capable of detecting or observing the phenomena occurring during operation.

The drilling fluid then continues downwardly into the diffuser 72 with the result being that the flow velocity decreases (v3) while the pressure (p3) increases, again in accordance with Bernoulli's principle. This pressure (p3), as will be seen from FIGS. 1, 2 and 4, acts on the opposing or outer face 84 of the pivoted flap 74, pressure (p3) being greater than the pressure (p2) acting on the inside face 86 of the flap. The net result is that the flap 74 tends to be forced toward the closed position as shown by the dotted lines. Hence, as a result of this pressure differential acting across the flap, flap 74 suddenly closes thus developing a water-hammer effect above the Venturi body 62 while at the same time the pressure (p3) below the constriction is reduced. The pressure force on the effective inside face of the flap 74 is now greater than pressure force acting on the outside surface of the flap and as a result of this pressure differential flap 74 swings open. The whole process described above now repeats itself rapidly in continuous cyclical fashion. By using this arrangement, and by changing the size and proportion of the several components, the pulsation rate can be made to vary over a relatively wide range.

It should be understood that in all of the disclosed embodiments a measure of back pressure downstream of the flow pulsing device exists at all times during operation. This back pressure arises as a result of the pressure drop across the bit jet nozzles and will vary depending on circumstances. The magnitude of this back pressure is not critical and need not be mentioned further.

It is also noted that the flap, in operation, does not actually make substantial metal-to-metal contact with the Venturi body in the opening and closing positions. At the pulsation frequencies normally encountered it appears that the drilling fluid may exert a cushioning effect thus reducing the degree of metal-to-metal contact and reducing the wear which would otherwise result.

In the embodiment of FIGS. 1–5 the flap 74 is pivoted by shaft 76 at the downstream end of the flap, i.e. the upstream free end swings in an arc between the open position (wherein the flap 74 is disposed within its pocket 73 in the Venturi body 62) and the closed position wherein the upstream free end portion is located within the passage 70 in the flow restricting position. It will readily be seen from an inspection of FIG. 2 that the flap closing pressure acts on a relatively large area AC (as shown by the dashed lines), such area comprising almost the whole outer face 84 of the flap 74. The total closing force is of course equal to the applied pressure times this particular area. On the other hand, the flap opening pressure, i.e. the pressure arising from water hammer effect (WHE) acts on only a relatively small area AO (as shown by the full line) such area comprising only the convexly curved upstream end surface 87 of the flap 74. (In this case area AC is more than twice the size of area AO). Further, the resultant of the opening force FO is inclined such that its effective moment arm relative to the axis of pivot shaft 76 is relatively short as compared with the length of the moment arm associated with closing force FC. The result of this is that the valve tends to stay closed for a longer period of time as compared with, for example, the embodiment of FIG. 8. In other words, the width of the pulse arising from the WHE is relatively wide thus providing for a substantial amount of mechanical energy to be transmitted to the bit as will become more apparent hereinafter.

Figure 8:
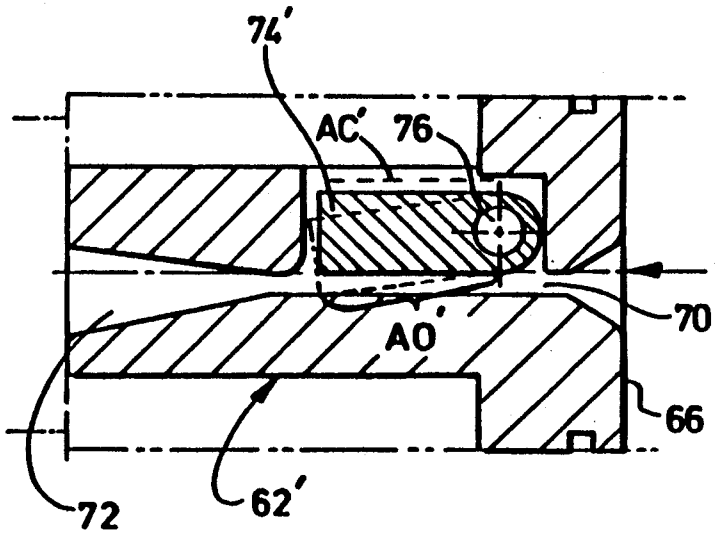
FIGS. 7 and 8 are longitudinal section views of alternate forms of flow pulsing devices for use in the embodiment of FIG. 1.

Referring to the embodiment of FIG. 8, only the Venturi body 62' and associated flap 74' are shown. Here the flap 74' is pivoted at its upstream end about pivot shaft 76. Here the flap closing pressure acts on the large area AC' defined by the rectangular outer face of the flap (shown by dashed lines) while the valve opening pressure acts on an equally large area AO' defined by the rectangular inner face of the flap (shown by solid lines). The moment arms of these forces about the pivot axis are almost equal to one another. Since the opening pressure associated with the WHE is quite high, the opening force is also large and the flap 74' opens very quickly as compared with the embodiment of FIGS. 1–5. The pressure pulse width arising from WHE is thus correspondingly narrow and the degree of mechanical energy arising from the pressure pulse is correspondingly less. The embodiment of FIGS. 1–5 is thus to be preferred over the embodiment of FIG. 8 for most situations although if reduced mechanical energy is desired the FIG. 8 embodiment should be selected.

Figure 7:
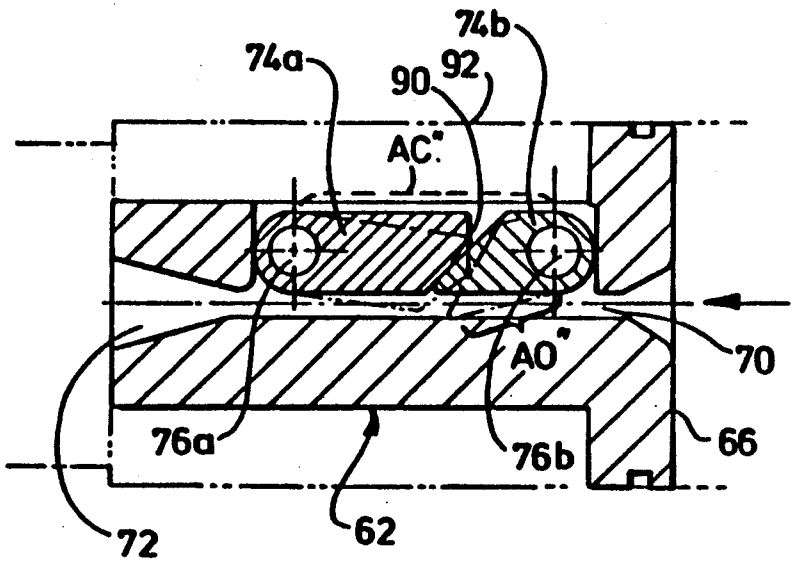

A still further variation is shown in FIG. 7 where a two-part flap comprising flap parts **74*a* and 74*b* are pivoted about respective downstream and upstream pivot shafts 76*a* and 76*b*. The flap parts are coupled together for motion by virtue of the respective inclined surface portions 90, 92. The opening pressure acts on an area AO" which is relatively small compared with the area AC" on which the closing pressure acts thus providing this embodiment with pressure pulse characteristics somewhat similar to those of the FIGS. 1–5** embodiment although at the expense of somewhat great complexity.

It will be seen from the above-described embodiments that if we reduce the flap area subject to the WHE (upstream) in relation to the area on which the flap closing pressure acts we will be able to obtain pressure pulses of longer duration. This means that during flow restriction (closure) the pressure pulse will travel higher upstream (at the speed of sound in liquid) and more fluid (a greater mass) will be stopped and more energy per pulse will be available as compared with, for example, the FIG. 8 embodiment.

Reference was made briefly to the constant diameter elongated bore 60 in the neck through which fluid flows during operation. The effect of diameter changes will become apparent when the flow velocity V is considered. The kinetic energy per pulse ($E=\frac{1}{2}MV^2$) and M=fluid weight/g. The weight=(density×volume)

and volume in turn=(cross-sectional area of bore 60×the total length of the decelerated fluid). The total length of decelerated fluid=(speed of sound in drilling fluid×time (i.e. duration of pressure pulse)). From this it will be understood that the reduced diameter bore 60 should extend upstream at least as far as a pressure wave will travel per cycle. The total energy per second is equal to the energy per pulse times the frequency (Hz).

From the above the advantage of the first flap embodiment (FIGS. 1–5) over the alternate embodiment of FIG. 8 in terms of the mechanical energy the system is capable of delivering to the drill string and the bit will be apparent. However, the embodiment of FIG. 8, with its narrower pulse width, is useful in applications where pulsations in the flow are desired to provide improved bottom hole cleaning with relatively little in the way of mechanical impulse energy being delivered to the bit.

Returning again to a consideration of factors affecting the magnitude of the pressure pulses provided, it is further noted that since Kinetic energy is proportional to the square of the velocity, reductions in diameter increasing the flow velocity in the bore 60 will have a significant effect on maximum energy available. Furthermore by increasing the velocity we increase the available rise in pressure due to water hammer effect, i.e. the momentary pressure rise=(specific density of drill fluid×speed of sound in drilling fluid×actual flow velocity of drill fluid). The momentary pressure rise acts on the face 66 of the Venturi body and the total force acting downwardly resulting from the WHE equals the momentary pressure rise×area of face 66.

Since, with each closure of the flap 74, a sharp pressure pulse will begin to travel upwardly, and since these upwardly travelling impulses will move along the drill string, it may be desirable to dampen them to some degree to reduce the chances of any detrimental effects arising. Accordingly, the lower end portion 96 of the neck 32 is provided with an energy absorbing collar 98 made from a tough resilient rubber-like (elastomeric) material, the outer surface being of conical form to intercept and gradually attenuate the upwardly moving train of pressure pulses.

As described previously there is a form of telescopic connection between the upper and lower tool housing portions permitting limited relative axial movement between them. Under certain conditions accelerations of the intermediate and bottom housings 22 and 24 can take place independently of the entire drill string. The vibrations are of minor amplitude so there may be no actual separation between annular shoulders 44, 46 except under conditions where very light drill string weight is applied, i.e. a lifting force could be applied to the drill string to reduce bit weight and give a vibrating bit effect. In general, at high bit weight (e.g. over 50,000 lbs.) there will likely be no difference in function between a telescoping housing and one that is non-telescopic (i.e. completely solid). At low bit weight, e.g. 20,000 lbs. the telescopic feature appears to come into play to provide the vibrating bit action coupled with low drill string weight.

The lower and upper tool portions are not only telescopically connected but also hydrostatically balanced (i.e. the inside diameters of the seals 52 and 54 are the same). The forces arising from WHE are transferred through the tool lower portion 24 (at the speed of sound in steel) to the bit. This vibration helps to break the rock while at the same time the cuttings are vibrated to enhance chip removal. Since the pressure pulses have a substantial width (as compared with the sharp instantaneous impulse in prior art hammers having steel-to-steel hammer-anvil contact) substantial energy is transferred to the bit but the action is much more gentle and less likely to damage the bit.

It is also noted here that the structures described are usable with conventional "rolling cone" bits, polycrystalline diamond bits and diamond bits as well. When using the diamond bit an arrangement providing reduced mechanical energy to the bit (e.g. the FIG. 8 embodiment) may be preferred. In all cases the bits will have enhanced performance due to better bottom hole cleaning of cuttings and/or the presence of structured jets as described hereafter.

An embodiment in accordance with FIGS. 1–5 has been operated within a wide range of frequencies and pressure pulses as high as 2500 psi have been observed. By varying the dimensions of the flap 74 and its surrounding structure and, to some extent, the pressure of the drill fluid, the desired pulsation rates can be achieved.

Figure 9:
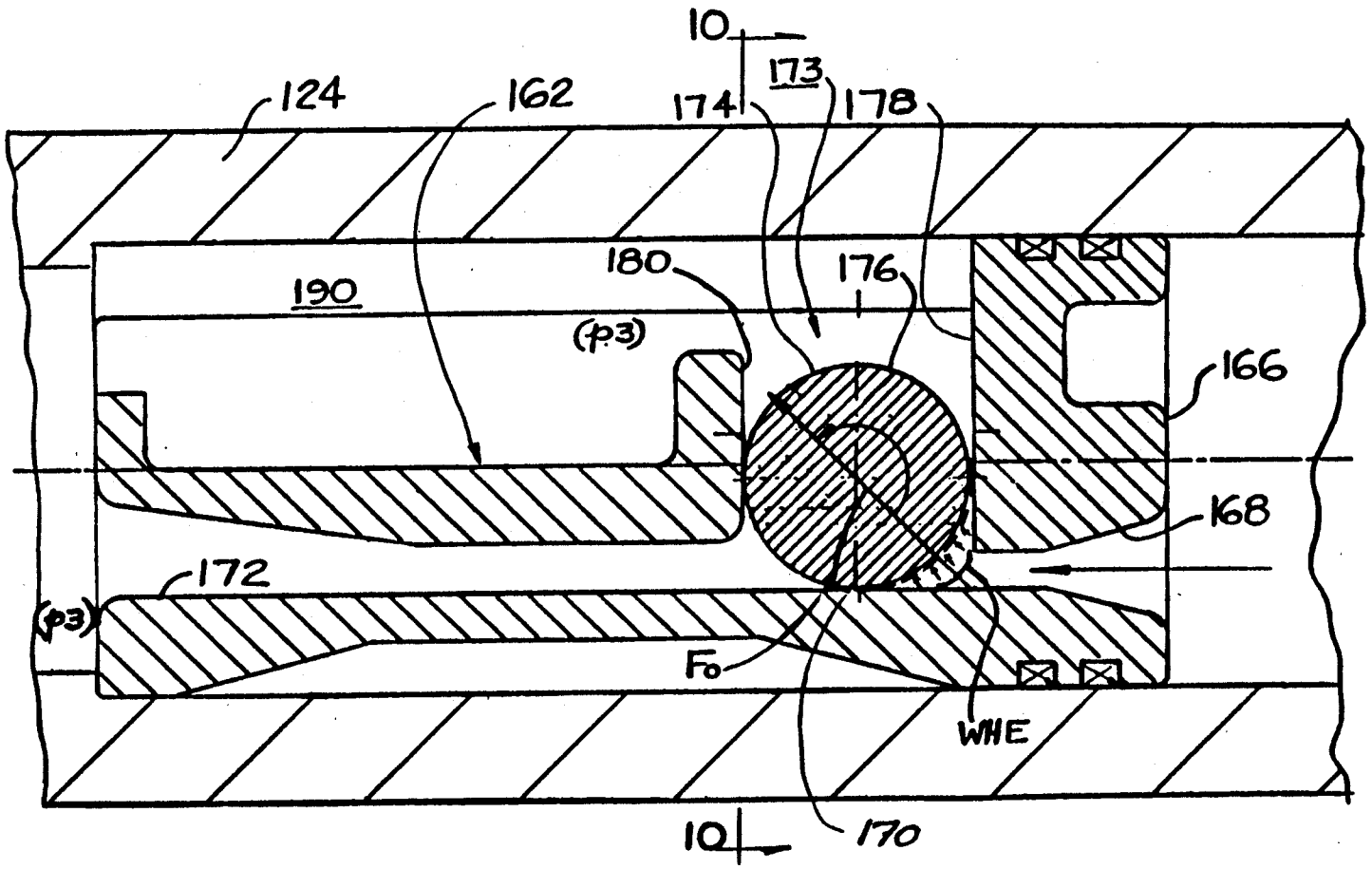
FIG. 9 is a longitudinal section view of a still further preferred embodiment having a rolling control element for producing pulses in the drilling fluid.
Figure 10:
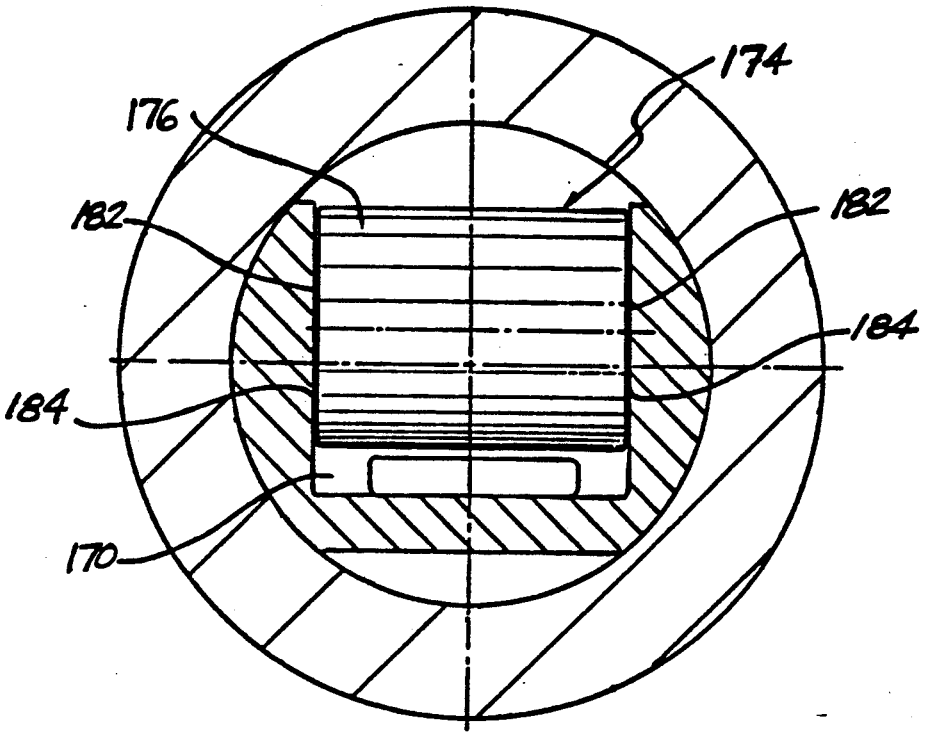
FIG. 10 is a cross-section view of the embodiment of FIG. 9 further showing the rolling flow pulsing element and taken along section line 10—10.
Figure 11:
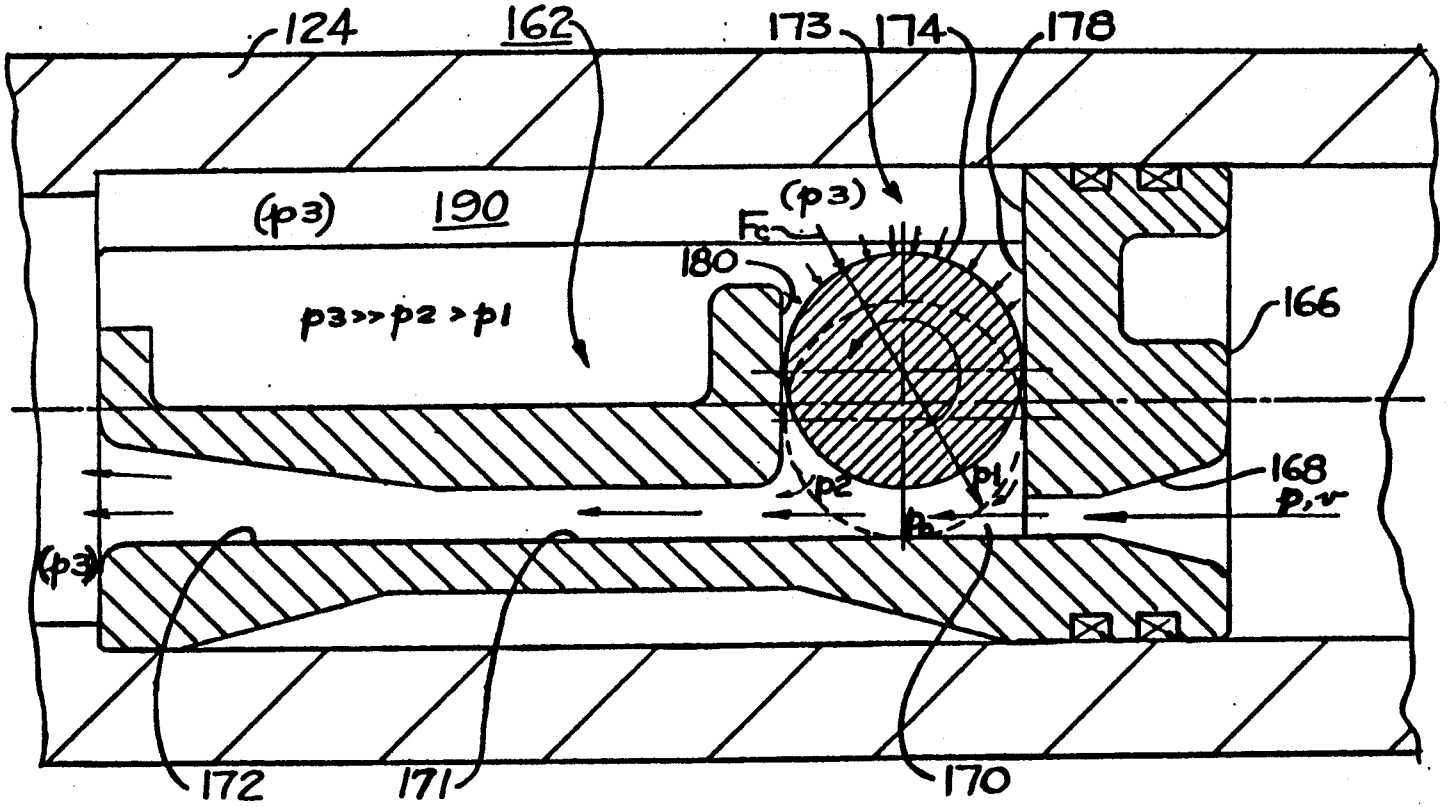
FIG. 11 is a section view as in FIG. 9 further illustrating the operation of this embodiment.

The embodiment illustrated in FIGS. 9–11 is believed to function in a manner similar to the embodiments previously described. This embodiment is positioned at the lower end of a drill string, just as is the embodiment of FIGS. 1–6, so the surrounding structures need not be again described.

The flow pulsing apparatus of FIGS. 9–11 includes a Venturi body 162 disposed in lower housing 124 and having an upstream face 166 within which is defined a region of gradual flow constriction 168 (downwardly tapering in size), a passage region 170 of high velocity flow (with generally rectangular cross-section) a slightly enlarged downstream passage portion 171 and a downstream passage region of gradual expansion defined by diffuser 172 (also of rectangular cross-section).

In the upper portions of the Venturi body 162 there is provided a pocket 173 extending at right angles to the lengthwise axis of the flow passages noted above. Pocket 173 is sized and shaped so as to contain with limited clearance, a cylindrical control element 174. The control element 174 or roller, as it may be termed, has its cylindrical side wall 176 confined between the planar upstream and downstream pocket wall surfaces 178, 180 respectively with only a slight clearance (e.g. 0.04 inch) sufficient to prevent jamming of the control roller 174 in the likely event of grit in the drilling fluid. The opposing planar end walls 182 of the control roller 174 are likewise in close juxtaposition to the remaining opposed pocket end walls 184, again with similar clearance being provided (e.g. 0.04 inch) to prevent binding in the likely event of fine grit in the drilling fluid. The exterior surfaces of control roller 174 and the walls of pocket 173 are well hardened to resist abrasive wear.

In operation of the embodiment of FIGS. 9–11, as before, the drilling fluid is pumped downwardly through the central bore of the drill string and has pressure (p) and (v) as it moves along and approaches the upper end of the Venturi body 162. The flow is accelerated in the constriction 168 and enters the passage region 170 of high velocity flow, thereafter entering the larger downstream passage region 171 and the diffuser 172 wherein the flow velocity is reduced. Since the pocket 173 is open on both its inner and outer sides, the control roller 174 has about one-half of its cylindrical sidewall 176 exposed to the pressures existing in passage region 170 while the remaining one-half of sidewall 176 is exposed to the pressure existing at the downstream outlet of the diffuser 172 just as in the case of the flap described in the previous embodiments.

FIG. 11 may be considered first. With the high velocity flow moving along passage region 170, and the control roller 174 displaced outwardly to the open full flow position, three low pressure regions (p0, p1, p2) appear. As best understood, because of the flow-induced pressure effects (which may be termed Bernoulli and/or "jet pump" effect, although the full theory of operation is somewhat unclear), and possible fluid drag effects, the pressure (p1) in the recess between the control roller sidewall 176 and the upstream pocket wall 178 appears to be less than the pressure (p2) between this same sidewall and the downstream pocket wall 180. The pressure (p3) acting on the opposing one-half of the control roller sidewall acts uniformly on that surface and, as noted above, is equal to the diffuser exit pressure (p3) owing to the fact that there is unrestricted communication between these spaced apart regions via the "open" region 190 between the interior of the housing 124 and the Venturi body 162. The pressure relationship thus established is that of (p3>>p2>p1). By virtue of this imbalance, the control roller 174 is urged inwardly toward the flow restricting position with the resultant closing force vector being shown as arrow Fc. Owing to the difference between p2 and p3 this force vector Fc is inclined inwardly and upwardly with the result being that the control roller 174 engages the upstream pocket wall 178 thus causing the control roller 174 to roll along that surface as it moves inwardly, the rotation being in the counterclockwise direction as seen in FIG. 11. This motion continues until the control roller approaches the closed, flow restricting position shown in FIG. 9 within the passage region 170. As soon as this position is reached, the forces acting on the control roller are reversed as shown in FIG. 9 Owing to the flow restriction, a water hammer effect (WHE) acts on that quadrant of the control roller sidewall which is exposed to the upstream pressure as shown by the arrows while the opposing half of the control roller sidewall is exposed to the now greatly reduced pressure (p3) existing downstream beyond the outlet of the diffuser section 172. Again, because of the imbalanced forces, the control roller 174 begins to move outwardly toward the full flow position, the resultant Fo of the opening forces being again inclined as shown in FIG. 9 so as to bring the control roller sidewall 176 into contact with the downstream pocket wall 180 and causing the roller to turn again in the same counterclockwise direction. The flow starts up again and the pressure imbalance situation described above in connection with FIG. 11 is again established so that the process described above repeats itself in a rapid cyclical fashion thus pulsing the flow to provide the beneficial effects noted with the preceding embodiments.

Because of the fact that the control roller 174 continually rotates during operation, the wear is distributed uniformly around the whole circumference of the sidewall 176 thus making for a long operating life even when substantial abrasives are present in the drilling fluid. Wear of the pocket upstream and downstream walls 178, 180 appears to be well tolerated; the system appears to be automatically self-compensating in the case of reasonable wear. Frictional effects are also much lower than with the flap arrangement, i.e. the rolling friction factor (f) can be in the order of 0.02 to 0.025 whereas a sliding friction factor would be in the order of 0.35, a 14 fold reduction, thus increasing the operating life of the component parts.

In recent above-ground tests which were carried out on the embodiment of FIGS. 9–11, the cylindrical control roller 174 (of steel) had a diameter of 2.25 inch and an axial length of about 2.9 inches. The remaining components were proportioned as shown in the drawings. The downstream end of the test apparatus was fitted with one jet nozzle of conventional design having a flow diameter of 0.30 square inches to approximate the downstream back pressure likely to be encountered in actual usage. Drilling fluid was applied at the upstream end of the apparatus, starting at about 1000 psi and gradually increasing to about 1200 psi (to roughly simulate conditions within a well bore) over which the observed flow went from about 300 to about 400 Imperial gallons/minute. At the peak pressures and flow rates, pulsation frequencies in the order of 50 to 55 Hz were measured. Lower pressures and flow rates produced lower pulsation frequencies.

It is contemplated that the cylindrical control roller 174 described above could be replaced with a steel control ball (not shown) of equivalent size, in which case the pocket 183 would be provided with a cylindrical sidewall sized to allow free motion of the ball, and the high velocity flow passage varied in shape to allow flow to be restricted when the control ball moves to the flow restricting position.

Apart from the primary uses described above other suggested uses of the invention in the course of downhole operations are:

(a) shaking of tubing to clean screens;
(b) vibrating of cement during cementing operations;
(c) pulsating a fluid being pumped into a formation to fracture it;
(d) vibrating a fishing jar to free a stuck bit or string.

Numerous non-drilling related applications wherein pulsations in a flow of fluid are desired will become apparent to persons skilled in the art of fluid mechanics generally.

Many variations of the flow pulsing apparatus will become apparent to those skilled in the art from the description given above. For definitions of the invention reference should be had to the appended claims.

I claim:

1. A liquid flow pulsing apparatus including a housing having means providing a passage for a flow of liquid and means for periodically restricting the flow through said passage to create pulsations in the flow and a cyclical water-hammer effect to vibrate the housing during use, said means for periodically restricting the flow including a constriction means in the passage to accelerate the flow to a higher velocity and a first passage region through which the accelerated higher velocity liquid flows followed by a downstream passage region adapted to provide for a reduced liquid velocity, and a movably mounted control means exposed in use to the liquid pressures associated with said first passage region and to the liquid pressures associated with said downstream passage region and adapted to move between a first generally full-flow position and a second flow restricting position in said first passage region by virtue of alternating differential liquid pressure forces associated with said first passage region and said downstream passage region and acting on said control means during use, and wherein said housing is arranged such that said movably mounted control means has one surface portion exposed to the liquid flow in said first passage region and a generally opposing surface position in communication with the liquid pressure existing in said downstream passage region, such that said control means tends to be moved rapidly in a cyclical fashion between the first and second positions by virtue of said alternating differential pressure forces which arise from liquid flow induced pressure effects and water hammer effects acting on said control means during use.

2. The flow pulsing apparatus according to claim 1 wherein the alternating differential pressure forces are created in that:

a) in the first position of the control means the accelerated liquid flows along said one surface portion, reducing the pressure forces thereon by liquid flow induced pressure effect, while pressure force on said opposing surface portion tends to increase by virtue of its exposure to the pressure of the downstream region of reduced liquid velocity thus tending to move the control means to the second position, and b) in the second position of the control means the flow restriction creates a water hammer effect thus increasing the pressure force on at least a portion of said one surface portion of the control means while at the same time the pressure in the downstream passage region drops thus reducing the pressure force on said opposing surface portion of the control means thus tending to open the control means, whereby said control means moves rapidly between said first and second positions thereby to effect pulsations in the flow of liquid.

3. The flow pulsing apparatus according to claim 1 further including jet nozzles downstream of said control member whereby a back-pressure is maintained in said downstream passage region during operation.

4. The flow pulsing apparatus according to claim 1 when adapted to be connected in a drill string above a drill bit with the water hammer effect producing pulsations in the flow of drilling liquid moving toward the bit thus vibrating the housing and the drill bit during use.

5. The flow pulsing apparatus of claim 1 wherein the means for periodically restricting the flow includes a pocket extending generally laterally of the first passage region and having an open inner side communicating with the first passage region and an open outer side communicating with the pressure of the downstream passage region, said control means being rollably mounted in said pocket for rolling motion therein between the open inner and outer sides of the pocket corresponding to the first and second positions respectively in response to the differential pressures exerted thereon in use.

6. The flow pulsing apparatus of claim 5 wherein said pocket has a pair of opposed side walls between which said control means is confined, said control means comprising a cylindrical element which rollingly engages opposing side walls of said pocket in alternate fashion as said element moves between the first and second positions during use.

7. The flow pulsing apparatus of claim 5 wherein said control means comprises a ball with the pocket having a cylindrical sidewall.

8. The flow pulsing apparatus according to claim 5 further including jet nozzles downstream of said control means whereby a back-pressure is maintained in said downstream passage region during operation.

9. The flow pulsing apparatus according to claim 8 when adapted to be connected in a drill string above a drill bit with the water hammer effect producing pulsations in the flow of drilling liquid moving toward the bit thus vibrating the housing and the drill bit during use.

10. A liquid flow pulsing apparatus including a housing having means providing a passage for a flow of liquid and means for periodically restricting the flow through said passage to create a cyclical water hammer effect to vibrate the housing and provide pulsations in the flow during use, said means for periodically restricting the flow including a constriction means in the passage to accelerate the flow to a higher velocity and a first passage region through which the accelerated higher velocity liquid flows followed by an enlarged downstream passage region adapted to provide for a reduced liquid velocity and a control means being associated with said first passage region, and means supporting said control means for movement relative to said first passage region between a generally full-flow position and a flow restricting position, said control means, in use, having one surface portion at least partially exposed to the higher velocity liquid flow through said first passage region such that (a) when the control means is in the full-flow position the higher velocity liquid flows tends to reduce the pressure force acting on at least a portion of said one surface portion and (b) when the control means is in the flow restricting position the flow restriction creates a liquid pressure force increase acting on at least a portion of said one surface portion while another surface portion of the control means which is generally opposed to the first mentioned surface portion is, in use, at least partially exposed to liquid pressures corresponding to those existing in said downstream passage region with said control means thus tending to be moved rapidly or to vibrate between the generally full-flow and flow restricting positions under the influence of the alternating differential pressure forces acting on said generally opposed surface portions of the control means during use.

11. The flow pulsing apparatus of claim 10 wherein said control means comprises a rollable element and said means supporting said control means for movement comprises a pocket extending laterally of the first passage region and having an open inner side communicating with the first passage region and an open outer side communicating with the downstream passage region, said rollable element being disposed in said pocket for rolling motion between the open inner and outer sides of the pocket corresponding to the closed and open positions respectively in response to the differential pressures exerted thereon in use.

12. The flow pulsing apparatus of claim 1 wherein said rollable element comprises a cylindrical element which rollingly engages opposing side walls of said pocket in alternate fashion during use.

13. The flow pulsing apparatus of claim 1 wherein said control means comprises a ball with the pocket having a cylindrical sidewall.

14. The flow pulsing apparatus of claim 1 further including jet nozzles downstream of said control member whereby a back-pressure is maintained in said downstream passage region during operation.

15. The flow pulsing apparatus of claim 4 when adapted to be connected in a drill string above a drill bit with the water hammer effect producing pulsations in the flow of drilling liquid moving toward the bit thus vibrating the housing and the drill bit during use.

16. A liquid flow pulsing apparatus including a housing means providing a passage for a flow of liquid and means for periodically restricting the flow through said passage to create a cyclical water hammer effect to vibrate the housing and provide pulsations in the flow during use, said means for periodically restricting the flow including a constriction means in the passage to accelerate the flow to a higher velocity and a first passage region through which the accelerated higher velocity liquid flows followed by an enlarged downstream passage region adapted to provide for a reduced liquid velocity, and a control means having opposed surface portions, said control means being associated with said first passage region, and means supporting said control means for movement relative to said first passage region between a generally full-flow position and a flow restriction position, said control means, in use, having one of said surface portions at least partially exposed to the higher velocity liquid flow through said first passage region such that (a) when the control means is in the generally full-flow position the higher velocity liquid flow tends to reduce the pressure force acting on at least a portion of said one surface portion and (b) when the control means is in the flow restricting position the flow restriction creates a liquid pressure force increase acting on at least a part of said one surface portion while the opposing one of said surface portions of the control means is, in use, at least partially exposed to liquid pressures corresponding to those existing in said downstream passage region with said control means thus tending to be moved rapidly or to vibrate between the full-flow and flow restricting positions under the influence of the alternating differential pressure forces acting on said generally opposed surface portions of the control means during use to create the cyclical water hammer effect.

17. The flow pulsing apparatus of claim 16 further comprising means defining a pocket adjacent said first passage region said pocket having inner and outer open sides, the inner one of the open sides communicating with the first passage region nd the outer one of the open sides communicating with the downstream passage region, and said control means being a flap located within said pocket and said means supporting said control means comprising pivot means securing said flap for pivotal motion in said pocket between the generally full flow and the flow restricting positions, the flap having opposed major faces defining said opposed surface portions, one of which faces in use is exposed to the pressures existing in the downstream passage region while the other face is exposed to the pressures in the first passage region.

18. The flow pulsing apparatus of claim 17 further including jet nozzles downstream of said control member whereby a back-pressure is maintained in said downstream passage region during operation.

19. The flow pulsing apparatus of claim 18 when adapted to be connected in a drill string above a drill bit with the water hammer effect producing pulsations in the flow of drilling liquid moving toward the bit thus vibrating the housing and the drill bit during use.

20. Apparatus as in claim 16 wherein said control means comprises a flap member, said flap member being mounted for pivotal motion between said positions about a pivot means disposed adjacent a downstream end portion of the flap member, said flap member being shaped such that a liquid pressure force effect tending to move the flap member from the flow restricting position toward the full-flow position acts on an area of said one face which is substantially smaller than the area of said opposing face on which the downstream pressure acts, thereby tending to provide relatively broad or longer duration pressure pulses in the flow.

21. Apparatus as in claim 16 wherein said control means comprises a flap member, said flap member being mounted for pivotal motion between the full-flow and flow restricting positions about a pivot means disposed adjacent an upstream end portion of the flap member, said flap member being shaped such that the liquid pressure force effect tending to move the flap member toward the full-flow position acts on an area of said one face which is substantially equal to the area of said opposing face on which the downstream pressure acts thereby tending to provide relatively short duration pressure pulses in the flow.

* * * * *